United States Patent [19]

Stoehr et al.

[11] 4,111,764

[45] Sep. 5, 1978

[54] METHOD FOR FEEDING A SUBLIMING MATERIAL INTO A LIQUID

[75] Inventors: Robert A. Stoehr, Pittsburgh; Robert J. Ormesher, Leechburg; Stanley C. Jacobs, Lower Burrell, all of Pa.

[73] Assignee: Aluminum Company of America, Pittsburgh, Pa.

[21] Appl. No.: 797,779

[22] Filed: May 17, 1977

[51] Int. Cl.[2] ..... C25C 3/00

[52] U.S. Cl. ..... 204/64 R

[58] Field of Search ..... 204/67–70, 204/64 R–66

[56] References Cited

U.S. PATENT DOCUMENTS

| | | | |
|---|---|---|---|
| 2,713,024 | 7/1955 | Mantovanello | 204/67 |
| 3,006,825 | 10/1961 | Sem | 204/67 |
| 3,551,308 | 12/1970 | Capitaine | 204/67 |
| 3,664,935 | 5/1972 | Johnson | 204/67 |

*Primary Examiner*—John H. Mack
*Assistant Examiner*—H. A. Feeley
*Attorney, Agent, or Firm*—David J. Hill; Daniel A. Sullivan, Jr.

[57] ABSTRACT

A method for feeding a subliming material into a liquid is disclosed, by which the end of a pipe is submerged below the surface of the liquid, and a subliming, particulate material is propelled through the pipe and into the liquid by a flow of gas. The flow rate of the entraining gas is sufficient to prevent the formation of deposits on the interior walls of the pipe by countercurrent gaseous diffusion of the subliming material.

5 Claims, 1 Drawing Figure

METHOD FOR FEEDING A SUBLIMING MATERIAL INTO A LIQUID

BACKGROUND OF THE INVENTION

The present invention relates to a method of feeding a subliming, particulate material into a liquid. More particularly, this invention relates to a method of feeding a subliming, particulate material into a molten salt electrolysis cell.

An example of such a cell is disclosed in U.S. Pat. No. 3,822,195 of Dell et al. issued July 2, 1974, for "Metal Production". The cell includes an anode, at least one intermediate bipolar electrode, and a cathode in superimposed spaced relationship defining interelectrode spaces. It is utilized for the production of metal from the metal chloride dissolved in a molten solvent. The metal is produced by electrolyzing the chloride-solvent bath in each interelectrode space to produce chlorine on each anode surface thereof and metal on each cathode surface thereof. A flow of bath is established and maintained through each interelectrode space to effect removal therefrom of metal produced, this flow being such that it sweeps metal therewith out of each interelectrode space. In the operation of such a cell, additional metal chloride must be incrementally or continuously fed into the bath.

It is known from U.S. Pat. No. 3,135,672 of Hirakawa et al. issued June 2, 1964, for "Method for Feeding Alumina to Electrolytic Cell" to employ unconfined jet of gas in the feeding of alumina to an electrolysis cell which utilizes the commercially widespread Hall-Heroult process. In this process, aluminum metal is produced by electrolytic reduction of alumina in a bath of fused cryolite or fluoride. This process is in general characterized by higher temperatures than those encountered in the electrolytic reduction of aluminum chloride, and by the formation on the surface of the bath of a thick, hard crust. Hirakawa uses an unconfined jet of gas in feeding such a cell to set up a fine vibration or rippling on the surface of the bath, and thereby to prevent the formation of crust on the bath surface. With the formation of crust being thus prevented, alumina is fed continuously and constantly into the bath without any obstacles.

It is also known, as described in U.S. Pat. No. 2,713,024 of Mantovanello for "Process for the Continuous Feeding of Electrolytic Aluminum Cells", issued on July 12, 1955, to feed alumina into the bath under a continuous gas pressure sufficient to overcome the mechanical resistance of the superficial crust so that the alumina is forced to penetrate into the molten bath.

A method for feeding solid aluminum chloride to an electrolysis cell by dropping it on the bath surface is discussed in United States Department of the Interior, Bureau of Mines Report 6785, entitled "Electrodeposition of Aluminum from Fused-Salt Electrolytes Containing Aluminum Chloride". This report describes the appearance of a small puff of vapor as the charge of aluminum chloride comes in contact with the molten electrolyte surface. The appearance of this puff of vapor is an indication of sublimation of some of the solid $AlCl_3$ to gas upon contacting the bath surface. Although such sublimation might not cause serious problems in an experimental situation (such as was the subject of the Bureau of Mines report), it presents problems that cannot be tolerated in a commercial operation. Such problems include the loss of availability of the $AlCl_3$ that vaporizes to a gas on contact with the bath surface. In addition, this $AlCl_3$ that has vaporized, or sublimed to gas, forms deposits upon reaching sufficiently cool surfaces, coating these surfaces and clogging orifices, etc.

SUMMARY OF THE INVENTION

This invention may be briefly described as a method by which a subliming, particulate material is fed into a liquid. According to the invention, a terminal orifice of a pipe is submerged in the liquid, and the particulate material is transported through the pipe, and into the liquid, in accompaniment with a flow of gas. The gas flow rate is great enough to prevent the formation of deposits of the subliming material by countercurrent gaseous diffusion.

This invention is particularly applicable to the feeding of a molten salt electrolysis cell with solid aluminum chloride. When the invention is used in this context, the gas-assisted feed of the solid aluminum chloride into the cell bath brings the aluminum chloride below the surface of the bath, where it can be rapidly dissolved therein. Thus, the problems of sublimation to gas upon contact with the bath surface, and subsequent sublimation back to solid on the cooler surfaces of the cell are avoided.

Accordingly, it is an object of the invention to provide a method by which a subliming, particulate material may be fed into a liquid.

It is another object of this invention to provide a method for feeding solid aluminum chloride to a molten salt electrolysis cell.

Another object of this invention is to avoid the escape of subliming solid aluminum chloride as it is being fed into an electrolysis cell.

A further object of this invention is to avoid the coating of surfaces in the cell with aluminum chloride that has sublimed to gas upon contact with the bath surface, and again to solid upon contact with cooler surfaces.

DESCRIPTION OF THE PREFERRED EMBODIMENTS

Figure 1:
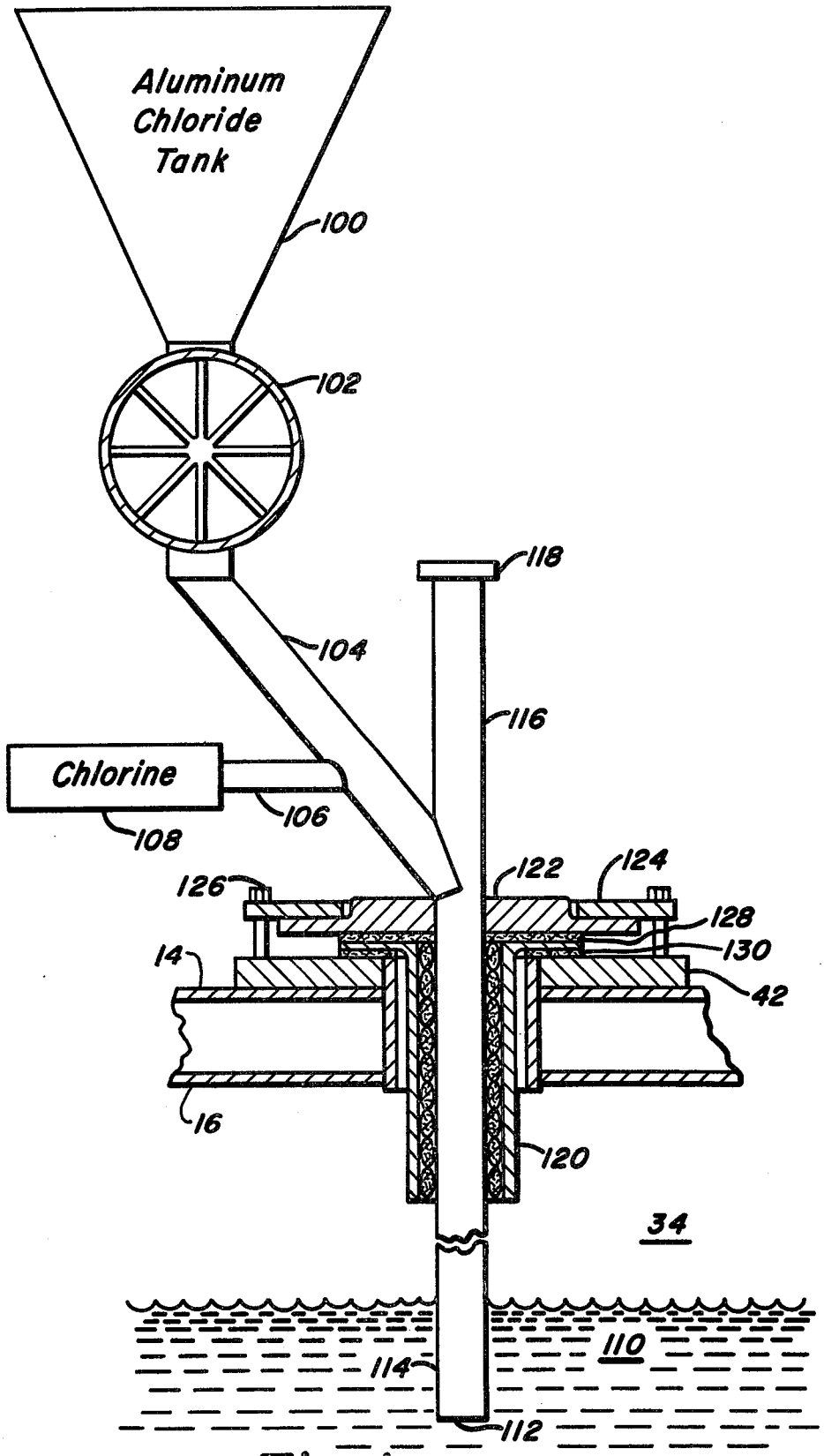
FIG. 1 is a sectional, elevational view of an embodiment of the present invention for feeding a subliming material.

With reference to FIG. 1, the essentials of apparatus for feeding according to the present invention are illustrated. The apparatus may be used in conjunction with the cell of the above-mentioned U.S. Pat. No. 3,822,195. With reference to FIG. 1 of that patent, lid 9 of that patent corresponds to lid 16 in the present FIG. 1, while port 11 there corresponds to port 42 here. The cell partially illustrated here, however, has been modified with respect to that shown in U.S. Pat. No. 3,822,195 to the extent that water cooling is provided on the top lid 16 here and the refractory roof 8 of that patent has been eliminated here. Thus, cooling jacket 14 covers the lid 16 of the cell. And, lid 16 is exposed directly to chlorine and salt vapors and is made of a suitably chlorine resistant metal such as the alloy nominally containing 80% Ni, 15% Cr, and 5% Fe and sold under the trademark Inconel. All water pipes running to and from the cooling jacket are provided with rubber hose electrical breaks, so that electrical current cannot move to or from the cell along the otherwise metallic pipes.

The cell cavity also includes a bath reservoir 34 (corresponding to reservoir 7 in U.S. Pat. No. 3,822,195) in its upper zone. The feeding port 42 provides an orifice extending through the lid 16 into bath reservoir 34 for feeding according to the present invention. Port 42 is made of the above-mentioned alloy sold under the trademark Inconel.

It has been found advantageous, both from the standpoint of economics and of handling ease, to feed aluminum chloride into an electrolysis cell in the solid state. An additional advantage is obtained from feeding $AlCl_3$ as a solid, because the change from solid $AlCl_3$ to $AlCl_3$ in solution is more endothermic than the change of gaseous $AlCl_3$ to $AlCl_3$ in solution. This removal of heat augments any external cell cooling process, such as water cooling, and allows the use of yet greater current levels in the cell, thereby increasing production per unit.

Tank 100 contains anhydrous aluminum chloride ($AlCl_3$) of granular form such as is produced for example by techniques set forth in U.S. Pat. No. 3,786,135 issued in the name of King et al. on Jan. 15, 1974 for "Recovery of Solid Selectively Constituted High Purity Aluminum Chloride from Hot Gaseous Effluent". Tank 100 appears relatively small on the drawing simply for ease of illustration and it will be recognized that it can have a very large capacity; for example, it may contain enough aluminum chloride to cover one day's consumption by the cell. Since aluminum chloride combines readily with the moisture in the air, which moisture is harmful for the electrolytic process (see the above-mentioned U.S. Pat. No. 3,725,222), tank 100 as well as all the remaining apparatus to be described in FIG. 1 is sealed to exclude air. A slight pressure of, for example, chlorine gas is maintained in tank 100, to make up for the loss of solids, as the aluminum chloride is fed out of tank 100.

The aluminum chloride is extracted from tank 100 by the use of a rotary valve 102 as shown. This valve has radially extending vanes, to accommodate between neighboring vanes substantially equal portions of aluminum chloride and to isolate tank 100 from the particular gas pressure conditions existing in pipe 104 connected to the outlet of valve 102.

Transport of the aluminum chloride downwards through pipe 104 is primarily effected by the force of gravity. At the junction of pipe 106 with pipe 104, a flow of chlorine gas is introduced from chlorine source 108. While other gases inert in the process might be used, e.g. nitrogen, chlorine is preferred, because chlorine is coming off the process anyway, whereas nitrogen would represent a second significant gaseous species, rendering, for instance, a gas liquefaction step more difficult. The chlorine flow must be at a pressure sufficient to overcome the tendency of the molten salt bath 110 to flow upwards in the open end 112 of quartz pipe 114, to which pipe 104 is open by virtue of its connection to rodding pipe 116. Chlorine thus moves under pressure through end 112 and, in doing so, distributes the descending aluminum chloride into the molten bath for rapid dissolution in the same.

While reference is made to the above-mentioned U.S. Pat. No. 3,822,195 for exemplary details of the electrolysis in the cell, it is noted that bath 110 may, for example, be at 715° C and have the following composition in weight percent:

| | |
|---|---|
| NaCl | 51.0 |
| LiCl | 40.0 |
| $AlCl_3$ | 6.5 |
| $MgCl_2$ | 2.5 |

For a quartz pipe 114 of 3-inch inner diameter (i.d.), a preferred chlorine flow rate is 38 scfh/in$^2$ (standard cubic foot per hour per square inch) of pipe cross section, while for a 4-inch i.d., a preferred flow rate is 32 scfh/in$^2$. Pipe i.d.'s of less than ½-inch have not been found practical, since the aluminum chloride tends to jam in such small tubes. It is believed that the minimum flow rate is 20 scfh/in$^2$, because it has been observed that, with lower flow rates, the aluminum chloride tends to escape from the bath as gas which works its way back up pipe 114 and pipe 104 and deposits e.g. on the pipe walls at locations of temperature below the sublimation temperature of $AlCl_3$. This phenomenon is referred to as countercurrent gaseous diffusion.

It will be realized that the bath 110 is always trying to encroach into pipe 114 to a further or lesser extent, depending on the static head of molten salt bath, on the pressure over the bath, and on the pressure in pipe 114. If the chlorine flow from pipe 106 is stopped such encroachment will in general occur. Additionally, gaseous aluminum chloride then starts to work its way back up tube 114 to cause encrustations. It is for both of these reasons that rodding pipe 116 is present. Its cap 118 may be removed, so that the system may be rodded clean of deposits.

In a system such as in FIG. 1, it will be realized that, for purposes of maintenance, it can be advantageous to provide valves and junctions (neither shown) in the various pipe lines. For example, it has been found advantageous to provide a valve pipe 104 between rotary valve 102 and the point where 106 enters. Then, when it is desired to close off the chlorine flow, this extra valve can first be closed, to prevent aluminum chloride gas from rising and, for example, changing to solid encrustations to plug rotary valve 102. It is also advantageous to provide a portion of pipe 104, below the junction of pipe 106, in the form of a rubber hose (not shown), to provide an electrical break.

The details of the connection around port 42 include a packing tube 120, with a ceramic fiber rope packing about quartz pipe 114. The flange 122 of pipe 116 is held to port 42 by means of a clamping ring 124 bound in place by bolts 126. The system is sealed by means of gaskets 128 and 130. Provision in the form of insulating bushings and washers (not shown) is made to eliminate the possibility of bolts 126 acting as an electrical current path.

It will be understood that the above description of the present invention is susceptible to various modifications, changes, and adaptations and the same are intended to be comprehended within the meaning and range of equivalents of the appended claims.

What is claimed is:

1. A method of feeding a subliming, particulate material into a liquid in a container, the liquid being above sublimation temperature, wherein the improvement comprises submerging a terminal orifice of a pipe in the liquid; the container being sufficiently large that liquid surrounds the terminal orifice; and transporting the subliming, particulate material through the pipe and into the liquid in accompaniment with a flow of gas, at a gas flow rate for preventing the formation of deposits of the subliming material by countercurrent gaseous diffusion of the subliming material.

2. The method of claim 1 wherein the rate is at least 20 standard cubic feet per hour per square inch of pipe cross section.

3. The method of claim 1 wherein the liquid is a molten electrolytic bath in a molten salt electrolysis cell.

4. The method of claim 3 wherein the material is aluminum chloride.

5. The method of claim 3 wherein the material is a metal chloride and the gas is chlorine.

* * * * *